US008733677B1

(12) United States Patent
Villardi et al.

(10) Patent No.: US 8,733,677 B1
(45) Date of Patent: May 27, 2014

(54) DETERRING WEAR AT A BEARING CONSTRUCT IN A BASKET MEDIA MILL

(71) Applicant: Hockmeyer Equipment Corp., Harrison, NJ (US)

(72) Inventors: Michael A. Villardi, Camden, NC (US); Shawnacy D. McManus, Moyock, NC (US); Herman H. Hockmeyer, Saddle River, NJ (US)

(73) Assignee: Hockmeyer Equipment Corp., Harrison, NJ (US)

( * ) Notice: Subject to any disclaimer, the term of this patent is extended or adjusted under 35 U.S.C. 154(b) by 0 days.

(21) Appl. No.: 14/090,623

(22) Filed: Nov. 26, 2013

(51) Int. Cl.
*B02C 17/16* (2006.01)

(52) U.S. Cl.
USPC ..... 241/21; 241/171; 241/172

(58) Field of Classification Search
USPC ..... 241/21, 171, 172
See application file for complete search history.

(56) References Cited

U.S. PATENT DOCUMENTS

| | | | | |
|---|---|---|---|---|
| 3,327,953 | A * | 6/1967 | Krumholz, Sr. | 241/98 |
| 5,184,783 | A | 2/1993 | Hockmeyer et al. | |
| 7,559,493 | B1 | 7/2009 | Hockmeyer et al. | |
| 7,828,234 | B1 | 11/2010 | Hockmeyer et al. | |
| 7,883,036 | B1 | 2/2011 | Cullens et al. | |

* cited by examiner

*Primary Examiner* — Mark Rosenbaum
(74) *Attorney, Agent, or Firm* — Arthur Jacob

(57) ABSTRACT

A media basket mill utilizes a media bed having very small media to attain a mixture of finely divided solids in a liquid vehicle. A method and an improvement for deterring wear at a bearing construct in the media basket mill precludes the entry into a bearing interface between a bearing surface of the bearing construct and a component rotating within the bearing construct of the very small media employed in the media basket mill. A barrier is interposed between the media held in the basket of the mill and the bearing interface so as to isolate the bearing interface from media within the basket and thereby deter the entry of media into the bearing interface and concomitant wear at the bearing interface.

22 Claims, 2 Drawing Sheets

DETERRING WEAR AT A BEARING CONSTRUCT IN A BASKET MEDIA MILL

The present invention relates generally to the dispersion of selected constituents into liquids through the utilization of a basket media mill in which solid constituents are finely divided and dispersed into a liquid vehicle, as in the manufacture of paints, coatings, inks and like products, and pertains, more specifically, to improvements in a basket media mill and method for deterring wear which otherwise might occur as a result of deleterious interaction of grinding media and feedstock within the basket of the mill with a basket bearing construct ordinarily exposed to the media and the feedstock during mixing operations.

An increasing demand for mixtures containing dispersions of very finely divided solids, such as inks utilized in ink-jet printers, and paints and other coatings exhibiting more well-defined colors in thinner layers, has given rise to a requirement for processing equipment and techniques which can produce the desired mixtures with greater ease, efficiency and economy. In an earlier patent, U.S. Pat. No. 5,184,783, the entire disclosure of which is incorporated herein by reference thereto, there is described a basket media mill of the type in which a basket containing a bed of grinding media is immersed within a mixture of liquid and solids to be dispersed in the liquid, held within a vessel, and the mixture is moved through the basket, and through the bed of media in the basket, to circulate the mixture in the vessel and divide and disperse the solids within the liquid vehicle. While such basket media mills have proved to be highly effective in quickly processing mixtures of liquid with dispersions of solids, the demand for still finer dispersions has dictated the use of smaller grinding media; however, it has been observed that as the size of the grinding media is decreased, the danger of excessive wear at the basket bearing construct of the basket media mill is increased due to deleterious interaction between the bearing construct and the grinding media, as well as the feedstock which carries fine dispersions of solids that can enter the bearing construct and, through aggressive abrasion, can cause excessive wear and early failure at the bearing construct. Early attempts at sealing the bearing construct against exposure to the grinding media and feedstock have met with little success since the highly abrasive nature of the grinding media and the feedstock soon wears away the sealing structure, enabling the grinding media and the feedstock to attack the bearing construct itself.

In U.S. Pat. No. 7,559,493, the entire disclosure of which is incorporated herein by reference thereto, the problem was addressed by diverting the grinding media and the feedstock away from the bearing construct during operation of the mill. While that arrangement was found effective where the size of the grinding media was great enough to avoid entry of the media into the clearance that exists at the bearing interface between the rotating and stationary components at the bearing construct, where the size of the media falls below that clearance dimension, it was found that once operation of the mill is discontinued, resulting in cessation of the centrifugal forces that maintained the media away from the bearing construct, the media field would collapse against the bearing construct, enabling entry of the very small media into the clearance space at the bearing construct, leading to wear at the interface between the rotating and stationary components.

As demand for the use of smaller and smaller media continues to grow, there is a need for apparatus and method capable of accommodating such smaller media in an effective and reliable manner. The present invention addresses that need through deterring wear at the basket bearing construct of a basket media mill by isolating the bearing construct from the grinding media and the feedstock present in the basket of the mill, thereby avoiding deleterious interaction between those components of the mill journaled at the bearing construct and the media, as well as the feedstock, and protecting against excessive wear at the bearing construct. As such, the present invention attains several objects and advantages, some of which are summarized as follows: Enables the processing of mixtures containing more finely divided solids within a basket media mill without encountering excessive wear at the basket bearing construct of the mill; renders practical the use of basket media mills in the processing of mixtures which require much finer dispersions of solids in a liquid vehicle, with the concomitant benefits of greatly reduced processing time and increased efficiency; eliminates the need for elaborate sealing structures and the like in protecting against excessive wear at the basket bearing construct of a basket media mill, especially during the processing of mixtures containing finer and finer dispersions of solids; enables the use of much smaller media in a basket media mill for accomplishing much finer dividing and dispersion of solids into a liquid vehicle; greatly increases the effective service life of a basket media mill, and especially a mill utilized for processing mixtures containing very finely divided solids, by deterring wear at the basket bearing construct of the apparatus.

The above objects and advantages, as well as further objects and advantages, are attained by the present invention which may be described briefly as an improvement in a media basket mill having a basket with a basket wall establishing an interior for containing a bed of very small media within the basket, an impeller outside the basket for rotating about an axis of rotation extending within the basket, and a drive shaft extending along the axis of rotation and coupled with the impeller, the drive shaft being journaled at a bearing interface between a bearing surface of a bearing construct and the drive shaft, juxtaposed with the basket wall while feedstock is passed through the basket, the improvement comprising: a barrier extending along the axis of rotation of the drive shaft, the barrier being interposed between the interior of the basket and the bearing interface so as to isolate the bearing interface from media within the basket and thereby deter the entry of media into the bearing interface and concomitant wear at the bearing interface.

In addition, the present invention provides a method for deterring wear at a bearing surface of a bearing construct in a media basket mill having a basket with a basket wall establishing an interior for containing a bed of very small media within the basket, an impeller outside the basket for rotating about an axis of rotation extending within the basket, and a drive shaft extending along the axis of rotation and coupled with the impeller, the drive shaft being journaled at a bearing interface between the bearing surface of the bearing construct and the drive shaft, juxtaposed with the basket wall, while feedstock is passed through the basket, the improvement comprising: interposing a barrier extending along the axis of rotation of the drive shaft, between the interior of the basket and the bearing interface so as to isolate the bearing interface from media within the basket and thereby deter the entry of media into the bearing interface and concomitant wear at the bearing interface.

The invention will be understood more fully, while still further objects and advantages will become apparent, in the following detailed description of preferred embodiments of the invention illustrated in the accompanying drawing, in which.

Figure 1:
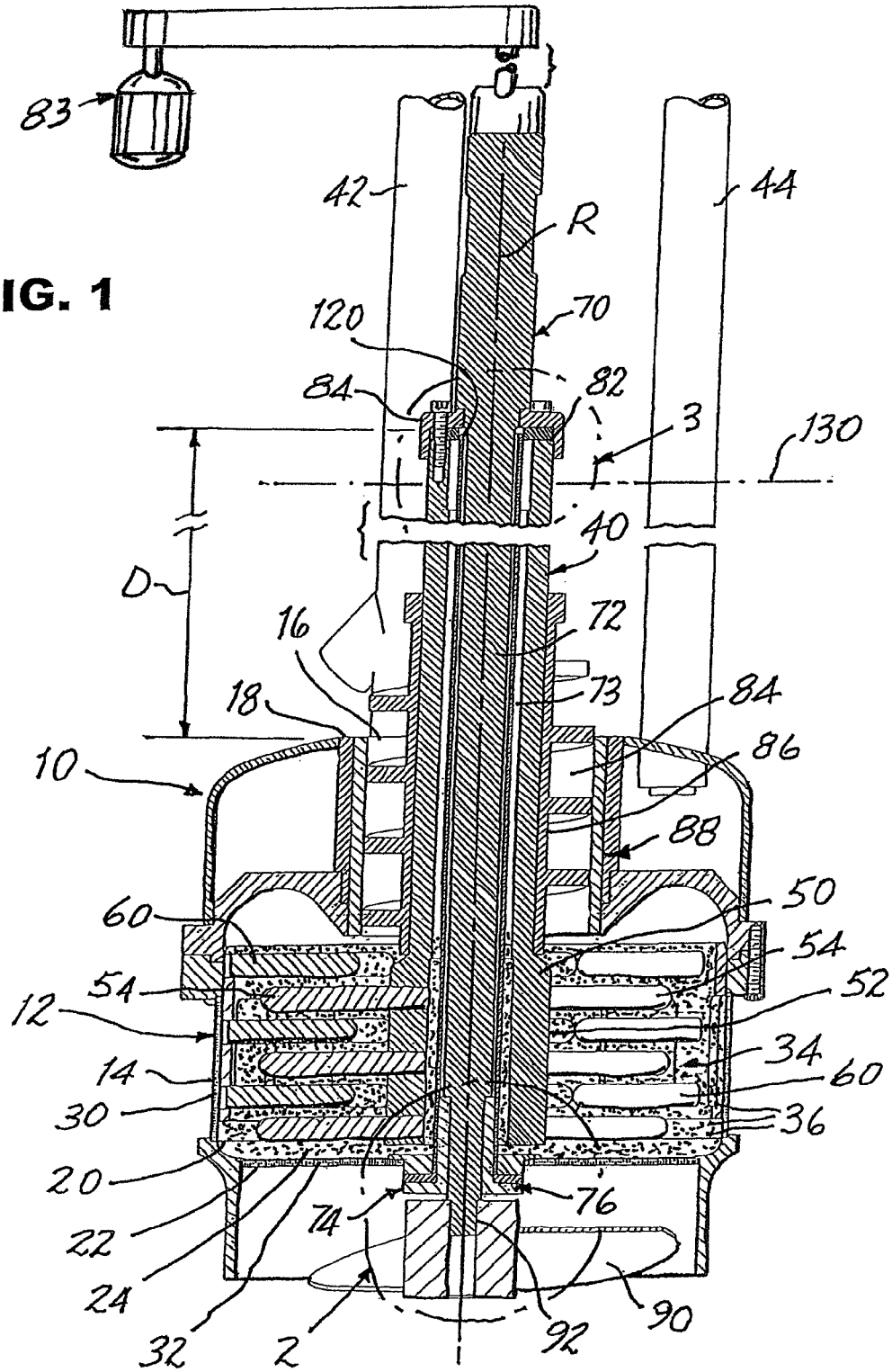
FIG. 1 is a partially diagrammatic longitudinal cross-sectional view of a basket media mill constructed in accordance with the present invention.

Referring now to the drawing, and especially to FIG. 1 thereof, a basket media mill constructed in accordance with the present invention is illustrated at 10 and is seen to include a basket 12 which is to be inserted selectively into a vessel (not shown), as described in the above-cited U.S. Pat. No. 5,184,783, so as to be immersed in the contents of the vessel. Basket 12 has a generally cylindrical configuration and includes a cylindrical side wall 14 extending axially from an entrance 16, at a top 18 at an upper end of the basket 12, vertically downwardly to a bottom 20 at a lower end of the basket 12. A bottom wall 22 spans the lower end of the basket 12 and completes the interior 24 of the basket 12. The cylindrical side wall 14 of the basket 12 is constructed of a material having openings 30 passing radially through the side wall 14. Similar openings 32 extend axially through the bottom wall 22, all as more fully described in U.S. Pat. Nos. 7,828,234 and 7,883,036, the entire disclosures of which patents are incorporated herein by reference thereto.

A media bed 34 is placed within the interior 24 of the basket 12 and is shown as a mass of grinding media comprised of discrete media elements illustrated in the form of beads 36. The relative dimensions of the beads 36 and the openings 30 and 32 are such that the media bed 34 is retained within the interior 24 of basket 12. That is, the dimensions of openings 30 and 32 are no greater than the minimum diameter of the beads 36 so as to facilitate the flow of the contents of the vessel, referred to as feedstock, through the basket 12 while preventing the escape of beads 36 from the basket 12.

A drive member in the form of an axle 40 extends axially into the basket 12 and is journaled for rotation relative to the basket 12, about a vertically oriented axis of rotation R. Columns 42 and 44 support the basket 12 and mount the basket 12 in a secure, fixed position within the vessel. A rotor 50 is carried by the axle 40 and includes a hub 52 which, in turn, carries a plurality of stirring rods in the form of pegs 54 extending radially outwardly from the hub 52, toward the side wall 14 of the basket 12, the pegs 54 being placed axially along the hub 52 and arrayed circumferentially around the hub 52. Upon rotation of the axle 40 and the hub 52, the pegs 54 will cause the beads 36 to move with a random up and down motion, rather than moving as a mass only in a rotational motion, and a desired shearing or grinding action is attained so as to divide solid material carried by the feedstock and disperse the divided solid material into, and mix the dispersed solid material with, the liquid vehicle of the feedstock. Any tendency toward packing of the of the media bed 34 or clogging of the openings 30 and 32 is reduced by the movement of the pegs 54. Generally, approximately ninety percent of the mixing accomplished within the basket media mill 10 takes place within the basket 12. A plurality of static rods in the form of counter-pegs 60 are affixed to the side wall 14 of the basket 12 so as to be stationary relative to the rotating pegs 54. The static counter-pegs 60 are juxtaposed with counterpart pegs 54 for interacting with the counterpart pegs 54 to attain combined attrition and rolling shear within the media bed 34, the static counter-pegs 60 extending radially inwardly from the side wall 14 of the basket 12, toward the hub 52 of rotor 50, axially adjacent counterpart pegs 54, so as to tend to stabilize the media bed 34 in radial directions while increasing the combined attrition and rolling shear attained between the counter-pegs 60 and the counterpart pegs 54.

Figure 3:
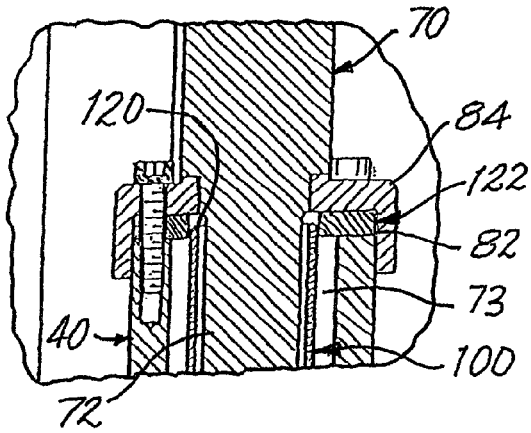
FIG. 3 is an enlarged fragmentary cross-sectional view of an upper portion of the mill, indicated by arrow 3 in FIG. 1.
Figure 2:
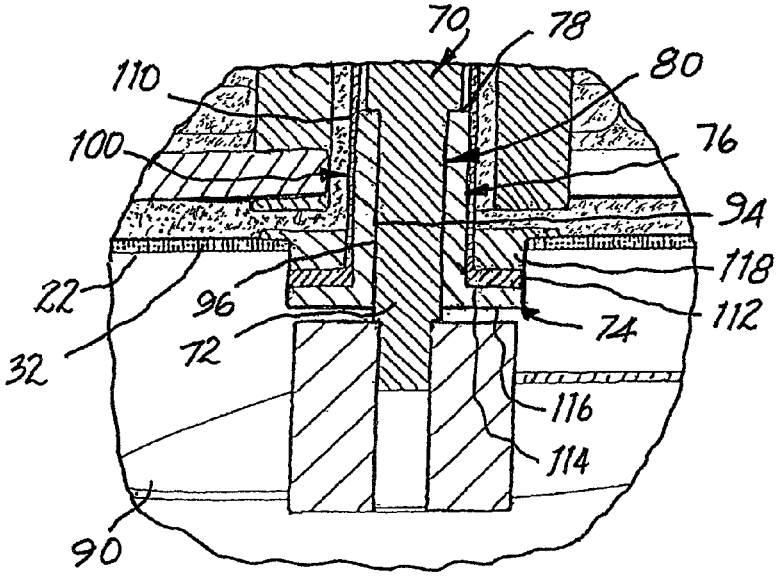
FIG. 2 is an enlarged fragmentary cross-sectional view of a lower portion of the mill, indicated by arrow 2 in FIG. 1.

Axle 40 is tubular, and a drive shaft 70 extends along axis of rotation R, coaxial with axle 40. A section 72 of drive shaft 70 is spaced radially from axle 40, establishing a gap 73 between axle 40 and section 72 of drive shaft 70. Section 72 of drive shaft 70 extends through hub 52 of the rotor 50 to pass axially into, and through, a basket bearing construct 74 which includes a bearing shown in the form of a bushing 76 secured to the bottom wall 22 of the basket 12. As best seen in FIG. 2, bushing 76 extends axially upwardly along drive shaft 70 into the interior 24 of the basket 12 and terminates at an upper end 78 so that drive shaft 70 is journaled for rotation within bushing 76, along a bearing interface 80 between section 72 of drive shaft 70 and bushing 76. As best seen in FIG. 3, axle 40 terminates at an upper, terminal end 82 and is coupled for rotation with drive shaft 70 by a connector shown in the form of a cap 84 which bridges gap 73 and is affixed to drive shaft 70 and to axle 40, such that the drive shaft 70 and the axle 40 will rotate as a unit. Upon rotation of the drive shaft 70, as by a drive mechanism 83 coupled to drive shaft 70, axle 40 is rotated and feedstock is fed into basket 12 through a tubular inlet passage 84 located at entrance 16, assisted by an upper impeller, shown in the form of helical screw impeller 86 fitted onto and coupled for rotation with axle 40, preferably within an upper bushing 88. A pressure differential established between the upper impeller and a lower impeller, illustrated in the form of impeller 90 affixed to the drive shaft 70 at 92 for rotation with drive shaft 70, outside basket 12, moves the feedstock through the basket 12, and through the media bed 34 within the interior 24 of the basket 12. At the same time, the rotor 50 is rotated to move the pegs 54 through the media bed 34.

As described in the above-cited U.S. Pat. No. 7,559,493, the size of the media in the media bed 34, that is, the size of the beads 36 of the illustrated embodiment, has, in the past, been limited to a range extending down to a minimum size of about 0.5 millimeter. The size of the divided solids dispersed into the liquid vehicle of a mixture being processed in a basket media mill is related directly to the size of the media in the media bed. Thus, in order to meet the requirements for dividing solids into very fine solid constituents and dispersing the fine solid constituents into the liquid vehicle to process a mixture of very fine solid constituents within the liquid vehicle, it becomes necessary to reduce the size of the media itself. However, it has been observed that by reducing the size of the media below about 0.5 millimeter, and preferably within a range reaching below 0.5 millimeter and down to about 0.01 millimeter, as described in the above-cited U.S. Pat. No. 7,828,234, the media becomes small enough to attack and abrade the basket bearing construct, which ordinarily is exposed to the media in the media bed, leading to excessive wear and early failure of the bearing construct, and a concomitant shortened service life of the basket media mill. The mechanism by which such an attack takes place is the ability of the very small media to enter the bearing construct at clearance present at the bearing interface between the bearing surface of the bearing construct and the rotating surface journaled within the bearing surface, the clearance being present at the bearing interface as a result of manufacturing tolerances, and interact with the confronting surfaces at the bearing interface to cause abrasion and consequent excessive wear, with concomitant deleterious consequences. For example, in the embodiment illustrated by basket media mill 10, the basket bearing construct 74 includes bearing interface 80 between the bearing surface 94 of bushing 76 and the rotating surface 96 of section 72 of drive shaft 70.

Figure 4:
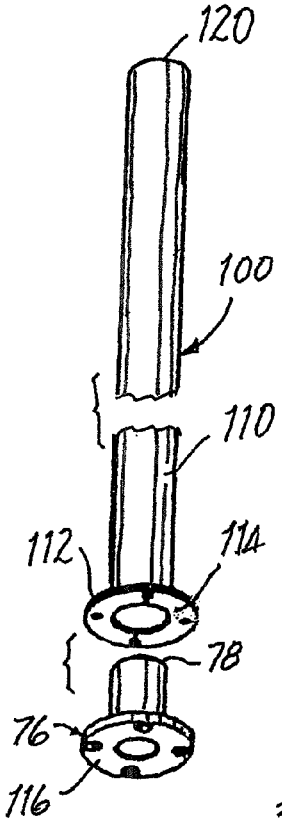
FIG. 4 is an exploded pictorial view showing certain component parts of the basket media mill.

The present invention protects against the entry of media into the clearance at the bearing interface 80 between the stationary bearing surface 94 of the bushing 76 and the rotating surface 96 of section 72 of the drive shaft 70, thereby deterring excessive wear which otherwise might occur if media were allowed to enter the bearing construct at the bearing interface 80. To that end, a barrier is interposed between the interior 26 of the basket 12 and the bearing interface 80 between the bearing surface 94 of bushing 76 and the rotating surface 96 of section 72 of drive shaft 70, the barrier being shown in the form of a tubular member 100 (also see FIG. 4) extending axially along the axis of rotation R and having a barrier wall 110 circumferentially surrounding the bearing interface 80. Barrier wall 110 is constructed so as to be impervious to the passage through the barrier wall 110 of media within the basket interior 24 of basket 12 and isolates the bearing interface 80 from the media within the basket 12. A flange 112 is integral with the tubular member 100 at the bottom end 114 of the tubular member 100 and anchors the tubular member 100 to the bottom wall 22 of the basket 12, the flange 112 being secured between a similar flange 116 of bushing 76 and a fitting 118 affixed to the bottom wall 22 of basket 12. In the preferred arrangement illustration in FIGS. 1 through 3, axis of rotation R extends in a substantially vertical direction and barrier wall 110 of tubular member 100 is coaxial with both the drive shaft 70 and axle 40, extending within gap 73 upwardly to a terminal end 120 and spaced radially from each of the drive shaft 70 and the axle 40. Preferably, terminal end 120 of tubular member 100 is stabilized by a further bushing 122 held in place by cap 84.

In the preferred construction, the terminal end 120 of barrier wall 110 is located at a prescribed vertical distance D above the top 18 of the basket 12 such that upon immersion of the basket 12 within a volume of feedstock having a vertically uppermost boundary, shown in phantom at 130, the barrier wall 110 will extend upwardly beyond the uppermost boundary 130 to preclude passage of any feedstock and, therefore, any media that might be carried by the feedstock, over the terminal end 120 and consequently preclude the entry of feedstock, and media, between the barrier wall 110 and the drive shaft 70, and into the bearing interface 80. Further, cap 84 preferably can be constructed in the form of a closure so as to fully close the gap 73 between the drive shaft 70 and the axle 40 adjacent the terminal end 120 of the barrier wall 110 thereby sealing the gap 73 against any entry of feedstock, and media, should the uppermost boundary 130 rise above the terminal end 82 of the axle 40, and the terminal end 120 of the barrier wall 110. In this manner, isolation of bearing interface 80 from media is assured, both during operation of the media basket mill 10 and upon cessation of the operation.

It will be seen, then, that the present invention attains all of the objects and advantages summarized above, namely: Enables the processing of mixtures containing more finely divided solids within a basket media mill without encountering excessive wear at the basket bearing construct of the mill; renders practical the use of basket media mills in the processing of mixtures which require much finer dispersions of solids in a liquid vehicle, with the concomitant benefits of greatly reduced processing time and increased efficiency; eliminates the need for elaborate sealing structures and the like in protecting against excessive wear at the basket bearing construct of a basket media mill, especially during the processing of mixtures containing finer and finer dispersions of solids; enables the use of much smaller media in a basket media mill for accomplishing much finer dividing and dispersion of solids into a liquid vehicle; greatly increases the effective service life of a basket media mill, and especially a mill utilized for processing mixtures containing very finely divided solids, by deterring wear at the basket bearing construct of the apparatus.

It is to be understood that the above detailed description of preferred embodiments of the invention is presented by way of example only. Various details of design, construction and procedure may be modified without departing from the true spirit and scope of the invention, as set forth in the appended claims.

The embodiments of the invention in which an exclusive property or privilege is claimed are defined as follows:

1. An improvement in a media basket mill having a basket with a basket wall establishing an interior for containing a bed of very small media within the basket, an impeller outside the basket for rotating about an axis of rotation extending within the basket, and a drive shaft extending along the axis of rotation and coupled with the impeller, the drive shaft being journaled at a bearing interface between a bearing surface of a bearing construct and the drive shaft, juxtaposed with the basket wall while feedstock is passed through the basket, the improvement comprising:

a barrier member extending along the axis of rotation of the drive shaft, the barrier member including a barrier wall interposed between the interior of the basket and the bearing interface, the barrier wall being impervious to the passage of the media through the barrier wall so as to isolate the bearing interface from media within the basket and thereby deter the entry of media into the bearing interface and concomitant wear at the bearing interface.

2. The improvement of claim 1 wherein the axis of rotation extends in a substantially vertical direction, the basket includes a bottom and a vertically opposite top, and the barrier member extends upwardly to a terminal end located vertically beyond the top of the basket.

3. The improvement of claim 2 wherein the terminal end of the barrier member is located a prescribed vertical distance above the top of the basket such that upon immersion of the basket within a volume of feedstock having a vertically uppermost boundary, the barrier member will extend upwardly beyond the uppermost boundary to preclude passage of feedstock over the terminal end and consequent entry of feedstock between the drive shaft and the barrier member.

4. The improvement of claim 1 wherein the barrier member comprises a tubular member extending axially along the axis of rotation such that the barrier wall circumferentially surrounds the bearing interface.

5. The improvement of claim 4 wherein the tubular member is affixed to the basket wall.

6. The improvement of claim 1 wherein the basket mill includes a rotor located within the basket, the rotor being coupled with the drive shaft for rotation with the drive shaft about the axis of rotation;

the axis of rotation extends in a substantially vertical direction;

the basket includes a bottom and a vertically opposite top;

the barrier member extends between a lower end adjacent the bottom of the basket and an upper, terminal end located vertically upwardly beyond the top of the basket;

a tubular axle extends vertically upwardly coaxial with the drive shaft and the bearing construct; and the tubular axle is coupled with the drive shaft adjacent the upper, terminal end of the barrier member.

7. The improvement of claim 6 wherein the barrier member comprises a tubular member extending coaxial with the drive shaft along the axis of rotation such that the barrier wall circumferentially surrounds the bearing interface.

8. The improvement of claim 7 wherein the tubular member is affixed to the basket wall.

9. The improvement of claim 7 wherein the tubular axle extends coaxial with the drive shaft, spaced radially from the drive shaft, and the tubular member is located radially between the drive shaft and the tubular axle.

10. The improvement of claim 9 wherein the tubular axle includes an uppermost terminal end spaced radially from the drive shaft by an annular gap, and a connector bridges the gap to couple the tubular axle with the drive shaft for rotation about the axis of rotation as a unit.

11. The improvement of claim 10 wherein the connector comprises a closure that closes the gap to preclude the entry of feedstock through the gap and between the barrier wall and the bearing interface.

12. A method for deterring wear at a bearing surface of a bearing construct in a media basket mill having a basket with a basket wall establishing an interior for containing a bed of very small media within the basket, an impeller outside the basket for rotating about an axis of rotation extending within the basket, and a drive shaft extending along the axis of rotation and coupled with the impeller, the drive shaft being journaled at a bearing interface between the bearing surface of the bearing construct and the drive shaft, juxtaposed with the basket wall, while feedstock is passed through the basket, the improvement comprising:

interposing a barrier member extending along the axis of rotation of the drive shaft, between the interior of the basket and the bearing interface, the barrier member including a barrier wall impervious to the passage of the media through the barrier wall so as to isolate the bearing interface from media within the basket and thereby deter the entry of media into the bearing interface and concomitant wear at the bearing interface.

13. The method of claim 12 including:

orienting the axis of rotation in a substantially vertical direction, with the basket including a bottom and a vertically opposite top; and extending the barrier member upwardly to a terminal end located vertically beyond the top of the basket.

14. The method of claim 13 including locating the terminal end of the barrier member a prescribed vertical distance above the top of the basket such that upon immersion of the basket within a volume of feedstock having a vertically uppermost boundary, the barrier member will extend upwardly beyond the uppermost boundary to preclude passage of feedstock over the terminal end and consequent entry of feedstock between the drive shaft and the barrier member.

15. The method of claim 12 including providing the barrier member in the form of a tubular member extending axially along the axis of rotation, with the barrier wall circumferentially surrounding the bearing interface.

16. The method of claim 15 including affixing the tubular member to the basket wall.

17. The method of claim 12 wherein the basket mill includes a rotor located within the basket, the rotor being coupled with the drive shaft for rotation with the drive shaft about the axis of rotation, the method including:

orienting the axis of rotation in a substantially vertical direction such that the basket includes a bottom and a vertically opposite top;

extending the barrier member between a lower end adjacent the bottom of the basket and an upper, terminal end located vertically upwardly beyond the top of the basket;

extending a tubular axle vertically upwardly coaxial with the drive shaft and the barrier member; and coupling the tubular axle with the drive shaft adjacent the upper, terminal end of the barrier member.

18. The method of claim 17 including providing the barrier member in the form of a tubular member, with the barrier wall extending coaxial with the drive shaft along the axis of rotation, circumferentially surrounding the bearing interface.

19. The method of claim 18 including affixing the tubular member to the basket wall.

20. The method of claim 18 including extending the tubular axle coaxial with the drive shaft, spaced radially from the drive shaft, and locating the tubular member radially between the drive shaft and the tubular axle.

21. The method of claim 20 including providing the tubular axle with an uppermost terminal end spaced radially from the drive shaft by an annular gap, and bridging the gap with a connector to couple the tubular axle with the drive shaft for rotation about the axis of rotation as a unit.

22. The method of claim 21 including closing the gap to preclude the entry of feedstock through the gap and between the barrier wall and the drive shaft.

* * * * *